US005836507A

United States Patent [19]

Mueller et al.

[11] Patent Number: 5,836,507

[45] Date of Patent: Nov. 17, 1998

[54] DISPLAY FOLDER

[76] Inventors: David C. Mueller, 1727 E. Midway Rd. #6; Daniel R. Coots, 2503 S. Greenview St., both of Appleton, Wis. 54915

[21] Appl. No.: 801,054

[22] Filed: Feb. 14, 1997

[51] Int. Cl.[6] ..... B65D 27/08

[52] U.S. Cl. ..... 229/67.1; 229/71; 229/72

[58] Field of Search ..... 229/71, 72, 67.1

[56] References Cited

U.S. PATENT DOCUMENTS

| | | | |
|---|---|---|---|
| 3,129,872 | 4/1964 | Lutwack | 229/72 |
| 3,174,244 | 3/1965 | Walton . | |
| 3,545,115 | 12/1970 | Nichols . | |
| 3,838,808 | 10/1974 | Schroeder | 229/71 X |
| 3,870,223 | 3/1975 | Wyant | 229/67.1 X |
| 4,141,162 | 2/1979 | Mascolo . | |
| 4,301,962 | 11/1981 | Monckton et al. . | |
| 4,640,413 | 2/1987 | Kaplan et al. . | |
| 4,934,584 | 6/1990 | Wyant . | |
| 4,989,777 | 2/1991 | Miller . | |
| 4,991,767 | 2/1991 | Wyant . | |
| 5,349,769 | 9/1994 | Okola . | |
| 5,417,509 | 5/1995 | Schwartz . | |
| 5,431,449 | 7/1995 | Arimoto et al. . | |

FOREIGN PATENT DOCUMENTS

| | | | |
|---|---|---|---|
| 44701 | 10/1910 | Germany | 229/71 |
| 250017 | 3/1911 | Germany | 229/71 |
| 450650 | 7/1936 | United Kingdom | 229/71 |

*Primary Examiner*—Jes F. Pascua
*Attorney, Agent, or Firm*—Quarles & Brady

[57] ABSTRACT

A folder, and a blank sheet for forming the folder, are disclosed. The folder includes apertures through which photographs or cards can be observed from the outside, and includes a securing tab received between panels to maintain the displayed items in an observable orientation.

3 Claims, 4 Drawing Sheets

DISPLAY FOLDER

CROSS REFERENCES TO RELATED APPLICATIONS

Not applicable

STATEMENT REGARDING FEDERALLY SPONSORED RESEARCH

Not applicable

BACKGROUND OF THE INVENTION

This invention relates to folders, and more particularly to folders having a cover configured to display photographs, sports cards, or similarly shaped display items.

Students and others desire uniquely personalized folders. U.S. Pat. No. 4,991,767 describes a folder that can be personalized by displaying photographs. This folder includes a front cover having openings covered by transparent film windows. An inner panel is adhesively secured to the outer panel in areas surrounding each window to define pockets for receiving photographs.

This folder has a number of shortcomings. First, it is difficult to assemble. Glue strips must tightly circumscribe each of the windows. If the glue is imperfectly provided the glue may prohibit complete insertion of a photograph or it will be incapable of maintaining an inserted photograph in a viewing orientation adjacent the window. Also, because the inner panel has to be separated along at least some perforated lines to insert photographs, the separated portions tend to hang open on the inside of a folder where they can become frayed and are susceptible to tearing. Frayed or torn folder sections are unappealing. Moreover, the requirement for a transparent film overlaying the openings adds cost and increases manufacturing time.

Other display folders have also been designed. However, they suffer from one or more of the shortcomings associated with the folder described above, and/or other shortcomings.

There is therefore a need for an improved folder which can be personalized.

BRIEF SUMMARY OF THE INVENTION

The invention provides a folder including a securing tab on a backing panel which is received between the other folder panels to maintain photographs, cards, or other items mounted on the backing panel in a single position observable through apertures in an outer front panel.

In one aspect the invention provides a blank sheet of foldable material for use in forming a folder. The blank sheet includes a first panel having lateral edges and upper and lower edges, a second panel integrally attached at a fold line to an edge of the first panel, the second panel having lateral edges upper and lower edges, and also at least one aperture. There is also a pocket panel integrally attached at a fold line to a lower edge of the second panel, and a backing panel integrally attached at a fold line to an edge of the second panel. The backing panel has lateral edges and upper and lower edges and includes at least one securer for retaining a displayable item. The backing panel also has a securing tab along one edge.

The panels of the blank sheet are juxtaposed such that when the folder is assembled by folding the sheet along the fold lines, the backing panel can hold a displayable item adjacent the aperture with the item observable through the aperture. The pocket panel (or a connection to the second panel) maintains the backing panel in this position by contact with the securing tab.

In a preferred aspect the second panel is attached at a lateral edge of the first panel. In another aspect the backing panel is attached to the second panel at a lateral edge of the second panel opposite the first panel. In yet another aspect the backing panel extends only partially along the second panel.

In another embodiment, the backing panel is attached at a top edge of the second panel. In this case the securing tab is on the edge of the backing panel opposite the second panel.

In another aspect the pocket panel is a first pocket panel attached at a lower edge of the second panel and the blank sheet also includes a second pocket panel attached at a fold line to a lower edge of the first panel. When the folder is assembled, the second pocket panel is positioned adjacent the first panel. The first and second pocket panels are attached at a common fold line. Preferably, the second panel has first and second portions and the backing panel can extend along the first portion. The blank sheet further includes first and second end flaps, the first end flap being attached at a lateral edge of the first panel opposite the second panel and the second end flap being attached at a lateral edge of the second panel opposite the first panel along the second portion.

In another embodiment the second panel is attached to the first panel along the upper edge of the first panel.

The invention also includes a folder having a first panel having lateral edges and upper and lower edges, a second panel integrally attached at a fold line to an edge of the first panel, the secured panel having lateral edges and upper and lower edges, and also at least one aperture, a pocket panel integrally attached at a fold line to a lower edge of the second panel, and a backing panel integrally attached at a fold line to an edge of the second panel. The backing panel has at least one securer for retaining at least one displayable item, the backing panel also having a securing tab along one edge. When the folder is assembled the backing panel can hold a displayable item adjacent the aperture with the item being observable through the aperture, and the pocket panel (or a connection to the second panel) can maintain the backing panel in this position by contact with the security tab.

Preferred display items are sheet-like such as photos or cards.

It is therefore an object of the invention to provide a blank having a securing tab that maintains display items in a position observable through viewing apertures.

It is another object to provide a folder formed of a blank that allows a user to easily remove or replace display items without damaging either the items or the folder.

It is another object to provide an inexpensive single sheet blank for forming a durable display folder.

A further object of the invention is to provide a folder of the type set forth above which is reliable, inexpensive and easy to manufacture.

The foregoing and other objects and advantages of the invention will appear from the following description. In the description, reference is made to the accompanying drawings which form a part hereof, and in which there is shown by way of illustration preferred embodiments of the invention. Such embodiments do not represent the full scope of the invention, however. Reference should therefore be made to the claims for interpreting the scope of the invention.

DETAILED DESCRIPTION

DETAILED DESCRIPTION OF THE INVENTION

Figure 1:
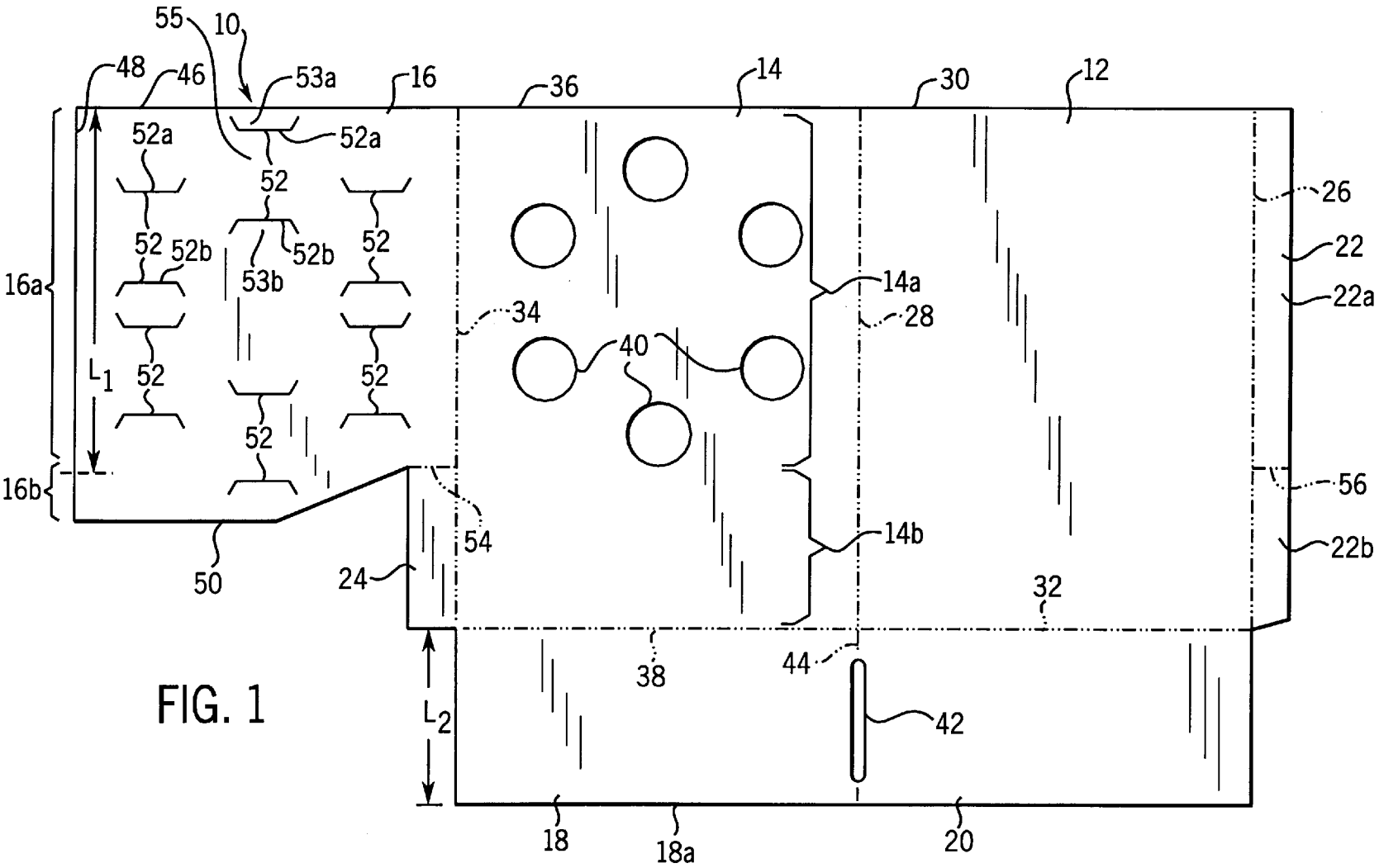
FIG. 1 is a plan view of a preferred embodiment of a blank sheet of the present invention.
Figure 2:
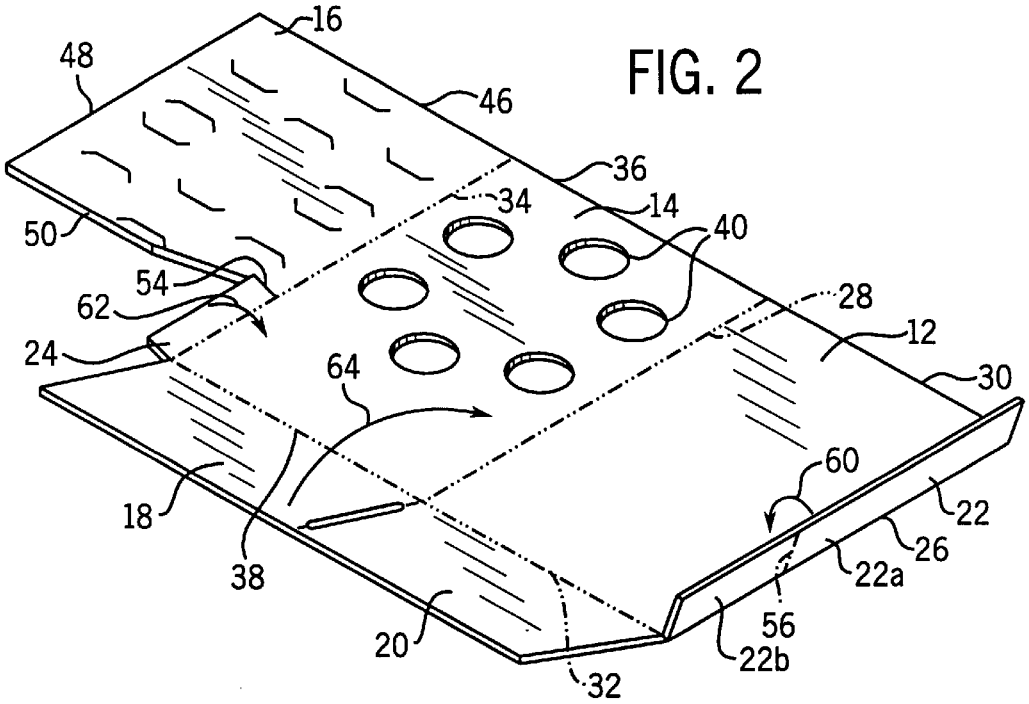
FIG. 2 is a perspective view of the blank of FIG. 1, albeit partially folded.

FIG. 1 shows a blank sheet 10 of thin gauge paperboard. When fully set up, the blank 10 forms folder 70 shown in FIGS. 4 and 5.

Blank sheet 10 is provided with a plurality of fold lines and perforated lines which together define various folder panels and flaps including a first (rear) panel 12, a second (outer front) panel 14, a backing panel 16, a first pocket panel 18, a second pocket panel 20, and end flaps 22 and 24.

Panel 12 is generally rectangular and has an upper edge 30, a first lateral edge defined by fold line 26, a second lateral edge defined by fold line 28 and a lower edge defined by fold line 32.

Panel 14 is also generally rectangular and has a size and shape that is almost identical to panel 12. Panel 14 has its own upper edge 36, a first lateral edge defined by fold line 28 where panel 14 is connected to panel 12, a second lateral edge defined by fold line 34 and a lower edge defined by fold line 38.

Panel 14 is generally divided into an upper section 14*a* that comprises approximately the upper two-thirds of panel 14 and a lower section 14*b* that comprises approximately the lower one-third section of panel 14. A plurality of apertures collectively identified by numeral 40 are preferably provided in the upper section 14*a*. In the embodiment illustrated, six apertures 40 are equispaced about the upper section 14*a* so as to form a circle of apertures. The apertures could alternatively be other shapes (e.g. rectangles).

Panel 16 is generally rectangular with a top edge 46, a first lateral edge defined by fold line 34 where panel 16 is connected to panel 14, a second lateral edge 48, and a bottom edge 50. Panel 16 generally comprises an upper mounting section 16*a* and a lower securing tab 16*b*. The mounting section 16*a* is approximately the same length $L_1$ as the upper section 14*a* of the panel 14 (i.e. length $L_1$ is approximately two-thirds the total length of panel 14).

Securing tab 16*b* is generally wedge shaped, extending downwardly from mounting section 16*a* further along lateral edge 48 than along fold line 34. Preferably, edge 50 terminates at a perforated line 54 at the bottom of the mounting section 16*a* adjacent fold line 34.

The mounting section 16*a* forms a plurality of generally "U" shaped slit pairs 52, each slit pair comprising an upper slit 52*a* and a lower slit 52*b* and forming a separate securer. Each slit pair 52 forms an upper tab 53*a* and a lower tab 53*b* which are separated by a backing section 55. The slits 52*a* and 52*b* are configured such that the distance therebetween matches at least one dimension of a photograph or other displayable item to be secured. Each slit pair 52 is positioned so that when panel 16 is folded over panel 14 along fold line 34, the upper slit 52*a* is adjacent an upper edge of an aperture 40 and the lower slit 52*b* is adjacent a lower edge of aperture 40. The tabs 53*a* and 53*b* and backing section 55 cooperate to secure a photograph or the like therebetween as will be described in more detail below.

First end flap 22 is connected to panel 12 along fold line 26 and is divided into an upper section 22*a* and a lower section 22*b* by a perforated line 56. The upper section 22*a* comprises approximately the upper two-thirds of the flap 22 and the lower section 22*b* comprises approximately the lower one-third. Second end flap 24 is connected to the lower portion 14*b* of panel 14 along fold line 34 and is connected to the panel 16 along perforated line 54.

Panel 18 is generally rectangular and has a width identical to the width of the outer front panel 14 and a length $L_2$ that is approximately the same size as the lower section 14*b*. Alternatively, the width can be slightly shorter than the width of the front panel 14. Pocket panel 18 is connected to panel 14 along fold line 38 and has a distal edge 18*a* opposite fold line 38.

An optional second pocket panel 20 is also generally rectangular having a size and shape that are substantially identical to the size and shape of the first pocket panel 18. The second pocket panel 20 is connected to panel 12 along fold line 32 and is connected to the first pocket panel 18 along a fold line 44. A slit aperture 42 is preferably provided along fold line 44.

In order to facilitate the following explanation, the surfaces of the panels and flaps observable in FIG. 1 will be referred to as internal surfaces and the surfaces that are not observable will be referred to as external surfaces. Turning now to FIGS. 2 through 5, in folding the blank 10 to form the folder 70, end flap 24 and panel 46 are folded together along fold line 34. As illustrated by arrow 62 so that the internal surfaces of flap 24 and panel 46 rest on the internal surface of panel 14. End flap 24 is later separated from panel 46 by tearing along perforated line 54 for insertion of pictures.

Prior to folding pocket panels 18 and 20, a strip of glue (not shown) can be provided on the internal surface of panel 18 adjacent flap 24, and the internal surface of flaps 22*a* and 22*b*. Then panels 18 and 20 are folded with the glue on panel 18 attaching to flap 24. Then flaps 22*a* and 22*b* are glued down as illustrated by arrow 60 so that the internal surface of 22*a* rests on the internal surface of panel 12 and the internal surface of 22*b* rests on the external surface of panel 20. In this way, when the glue cures the pocket panels 18 and 20 and flaps 22*b* and 24 will be secured to form folder pockets by tearing along perforated lines 54 and 56.

At this point, photographs or the like 66 can be installed between slit pairs 52 once backing panel 16 is lifted until securing tab 16*b* comes out from between panels 18 and 14 (see FIG. 3) and is folded back along line 34.

Figure 3:
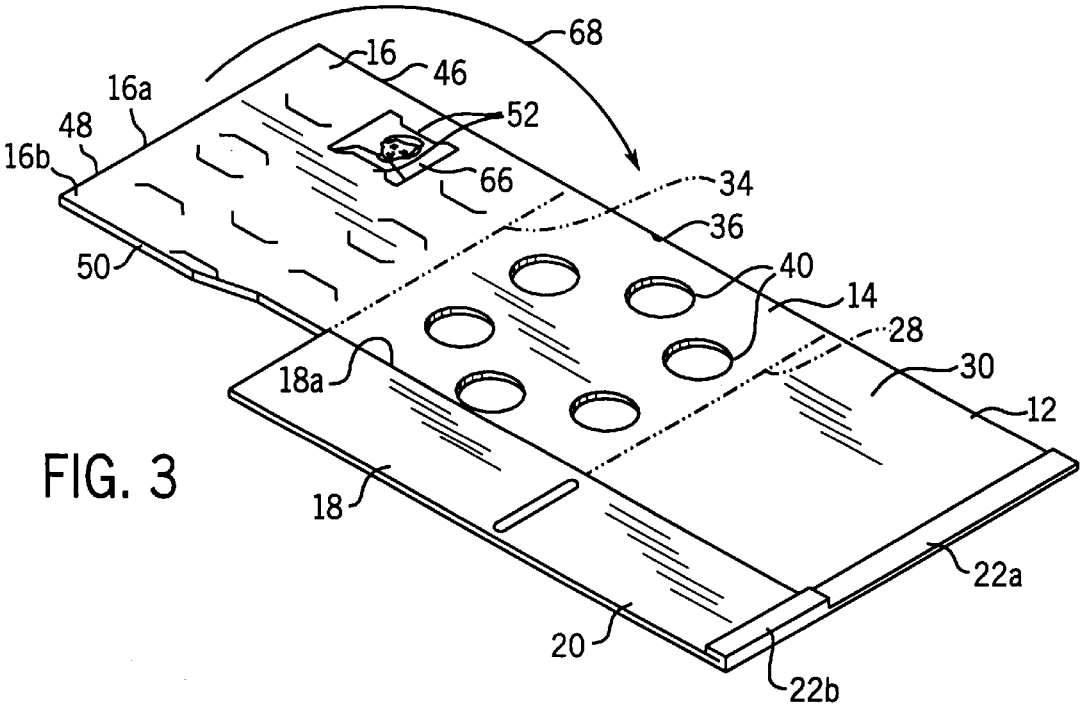
FIG. 3 is a perspective view of the blank of FIG. 1, in a further stage of folding, and with a photograph mounted thereon.
Figure 6:
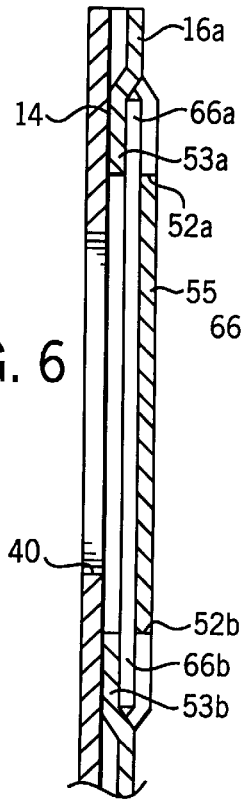
FIG. 6 is a partial cross-sectional view taken along line 6—6 of FIG. 4.
Figure 5:
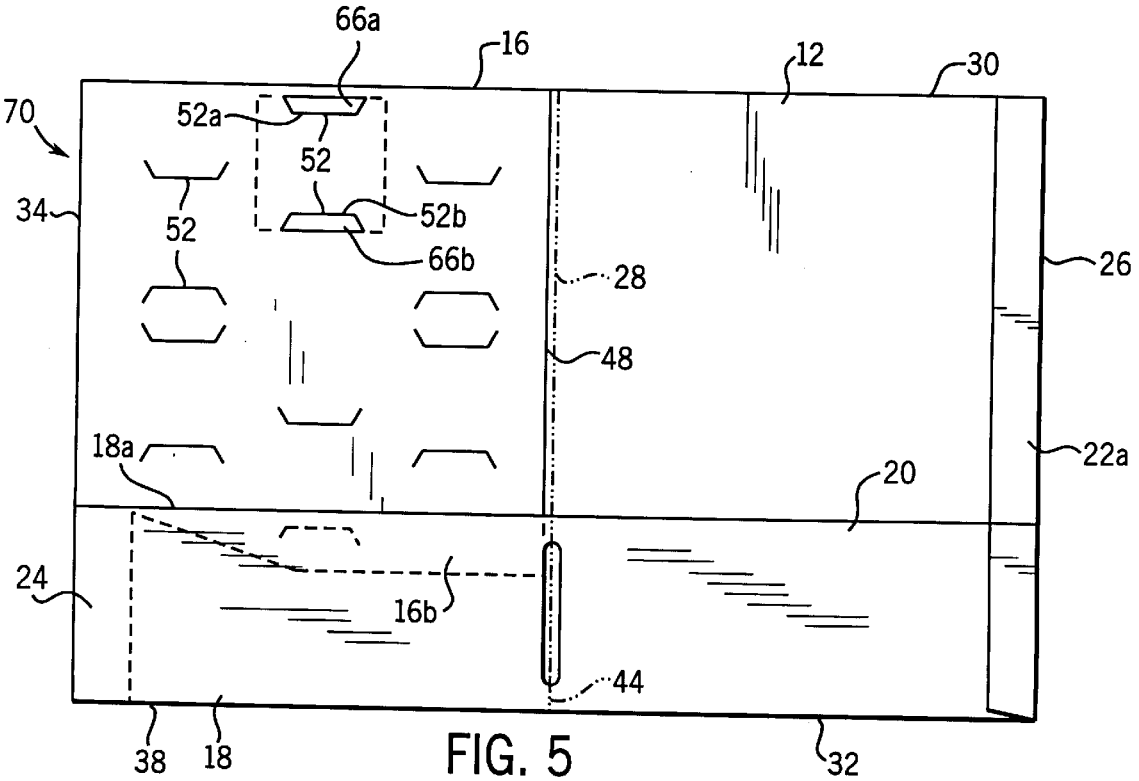
FIG. 5 is a plan view of the assembly of FIG. 4, albeit with the folder in an open orientation.

Referring to FIGS. 3, 5 and 6, to install a photograph 66, a finger is used to separate the mounting section 16*a* at the upper slit 52*a* and lower slit 52*b* so that the upper tab 53*a* and lower tab 53*b* can be pulled away from backing section 55. Then a photograph 66 is inserted between the tabs 53*a*, 53*b* such that an upper end 66*a* of the photograph 66 is positioned between an external surface of the upper tab 53*a* and an internal surface of backing section 55 and a lower end 66*b* of the photograph 66 is positioned between an external surface of lower tab 53*b* and an internal surface of backing section 55.

Referring to FIGS. 3 and 5, with one or more photographs installed between slit pairs 52, the backing panel 16 is folded along fold line 34 in the direction indicated by arrow 68 until the internal surface of the panel 16 rests on the internal surface of panel 14. Then, securing tab 16*b* is bent while the distal edge 18*a* of the first pocket panel 18 is raised so that securing tab 16*b* can be inserted between the pocket panel 18 and the inserted panel 14. In this manner, the pocket panel 18 maintains the backing panel 16 in its folded position and the folder 70 appears as illustrated in FIG. 5.

To complete set up, panel 14 is folded along fold line 28 until the external surface of backing panel 16 rests on the internal surface of panel 12. (See FIG. 4.)

Figure 4:
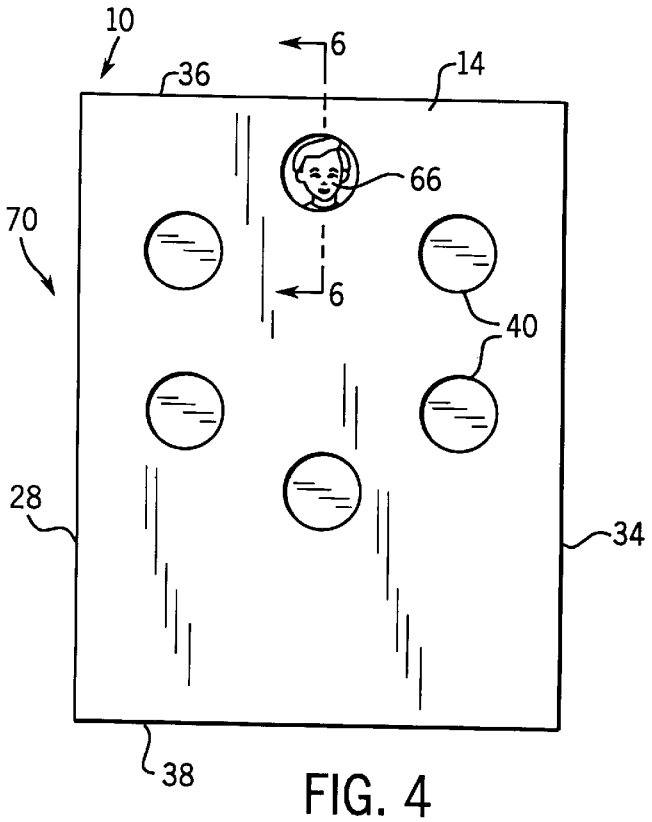
FIG. 4 is a front view of an assembly formed from the assembly of FIG. 3.

Referring to FIGS. 4 and 6, it can be seen that when the folder 70 is formed, photographs or the like secured by tabs 53*a* and 53*b* are observable through apertures 40. Referring also to FIG. 5, even when the folder is in an open orientation so that pockets formed between panels 18 and 14 and 20 and 12 can be accessed, tab 16*a* is between distal edge 18*a* and panel 14 so that photographs 66 are observable through apertures 40.

Referring to FIG. 5, to replace photographs 66, with the folder in the open orientation a finger can be inserted between panel 16 and panel 14 and panel 16 can be lifted until securing tab 16*a* comes out from between panels 18 and 14. (See FIG. 3.) Photographs 66 can be removed from slit pairs 52 and new photographs can be inserted. Then, panel 16 can again be folded along fold line 34 as illustrated by arrow 68 and tab 16*b* can be inserted between panels 18 and 14.

It should be appreciated that a simple, inexpensive folder has been described that can be personalized by displaying photographs or the like. Securing tab 16*b* cooperates with pocket panel 18 and panel 14 to provide an effective securing mechanism maintaining photographs in a viewing orientation without requiring glue or other permanent means.

The above description has been that of a preferred embodiment of the present invention. It will occur to those who practice the art that modifications may be made without departing from the spirit and scope of the invention. For example, modifications may be made with regard to the shape and size of the various panels and with regard to the apertures in panel 14. Also, apertures 40 may include only a single aperture or may include several rows or columns of apertures. Moreover, the glue flaps could be positioned on the edges of other panels.

Figure 7:
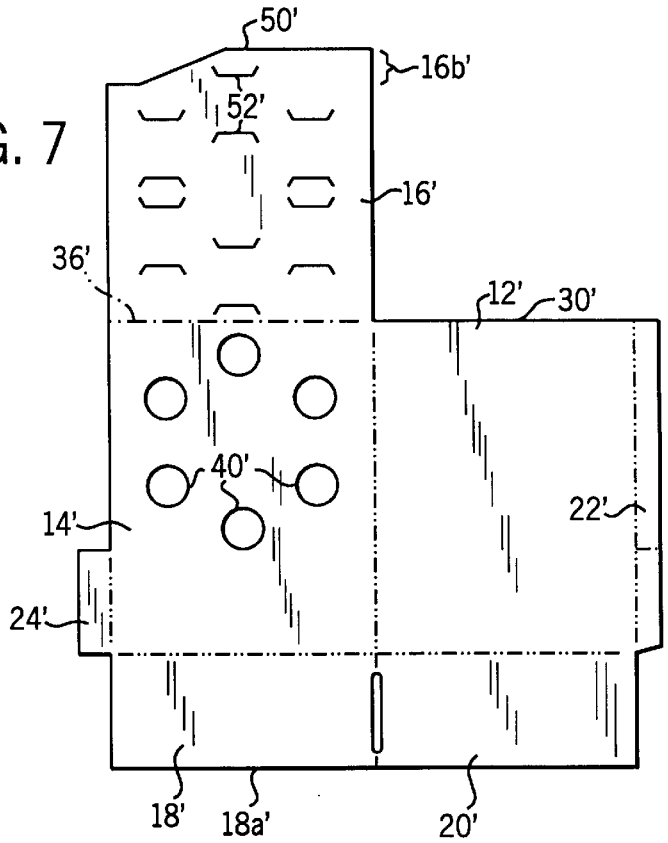
FIG. 7 is a plan view of a second embodiment of a blank sheet of the present invention.

In addition, referring to FIG. 7, where analogous numbers refer to analogous parts (e.g. 16' v. 16), another embodiment may include a panel 16' attached along an upper edge 36' of panel 14' which folds down thereover so that a securing tab 16*b*' of panel 16' can be received between the distal edge 18*a*' and panel 14'. All other elements illustrated in FIG. 7 are similar to elements illustrated in FIG. 1 and operate in the same manner.

Figure 8:
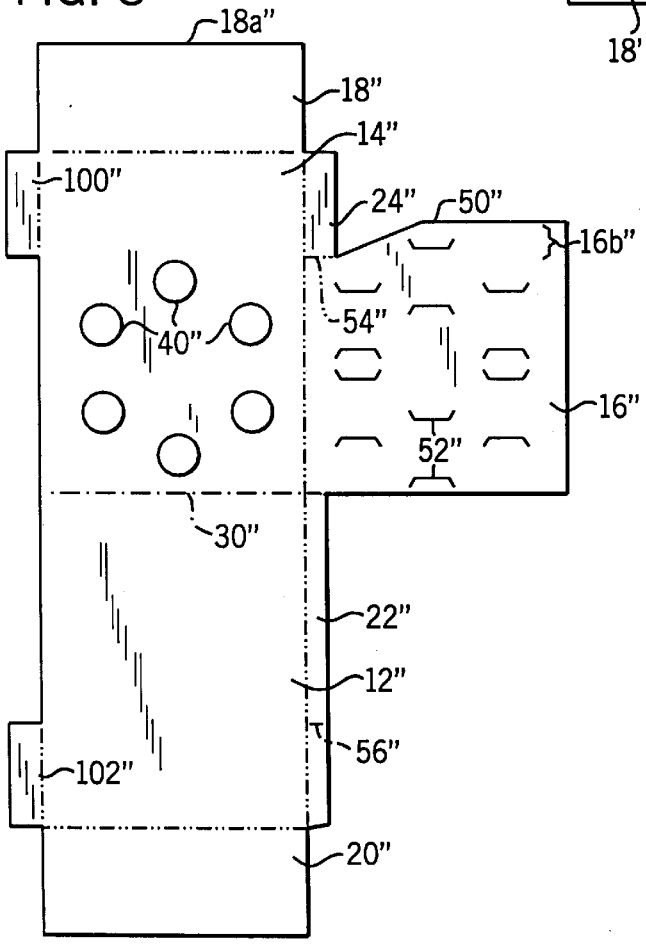
FIG. 8 is a plan view of a third embodiment of the blank sheet of the present invention.

Referring to FIG. 8, yet another blank embodiment may include panel 14" attached along an upper edge defined by fold line 30" of the panel 12", and a panel 16" that extends laterally from panel 14". In this case, additional end flaps 100 and 102 may be required to maintain pocket panels 18" and 20" in a secure orientation after a folder is formed.

To fold this blank into a folder, end flaps 22" and 24" are separated along perforated lines 56" and 54", respectively. All end flaps 22", 24", 100" and 102" are folded over so that their internal surfaces (observable in FIG. 8) rest on the internal surfaces of adjacent panels 14" or 12". Pocket panels 18" and 20" are folded so that their internal surfaces rest on the internal surfaces of panels 14" or 12". Again, glue strips can be added to the external surfaces of flaps 22", 24", 100" and 102" to secure pocket panels 18" and 20". Photographs are secured in slit pairs 52", panel 16" is folded over panel 14" and tab 16*b*" is placed between pocket panel 18" and panel 14". Panel 14" is then folded over panel 12" along fold line 30" so that the external surface of panel 16" rests on the internal surface of panel 12".

Furthermore, while slit pairs have been described, clearly the present invention would incorporate slit groupings including more or less than two slits (i.e. one, three or four slits to hold a single photograph), and/or other display item securers.

Alternatively, detachable coupons could be provided on the outer edge of flaps 22*a* and *b*. Also, instead of having the pocket hold the backing panel, one can provide Velcro® or a pressure sensitive adhesive on internal surfaces of the upper part of panel 14 and of panel 16 so that they removably stick together.

To apprise the public of the scope of this invention we make the following claims.

We claim:

1. A display folder, comprising:

a first panel having lateral edges and upper and lower edges;

a second panel integrally attached at a fold line to an edge of the first panel, the secured panel having lateral edges, upper and lower edges, and also at least one aperture;

a pocket panel integrally attached at a fold line to a lower edge of the second panel; and a backing panel integrally attached at a fold line to an edge of the second panel, the backing panel having at least one securer for retaining at least one displayable item on the backing panel as the backing panel is folded and unfolded relative to the second panel, the backing panel also having a securing tab along one edge;

wherein the backing panel can hold a displayable item adjacent the aperture with the item being observable through the aperture, and the pocket panel or a connection to the second panel can removably maintain the backing panel in this position by contact with the securing tab.

2. The folder of claim 1, wherein each securer is a slit.

3. A blank sheet of foldable material for use in forming a folder, the blank sheet comprising:

a first panel having lateral edges and upper and lower edges;

a second panel integrally attached at a fold line to an edge of the first panel, the second panel having lateral edges, upper and lower edges, and at least one aperture;

a pocket panel integrally attached at a fold line to a lower edge of the second panel; and a backing panel integrally attached at a fold line to an edge of the second panel, the backing panel having lateral edges and upper and lower edges and including at least one securer for retaining a displayable item, the backing panel having a securing tab along one edge;

wherein the panels of the blank sheet can be juxtaposed such that when the folder is assembled by folding the sheet along the fold lines, the backing panel can hold a displayable item adjacent the aperture with the item observable through the aperture, and the pocket panel or a connection to the second panel can maintain the backing panel in this position by contact with the securing tab;

wherein the second panel is attached at a lateral edge of the first panel;

wherein the pocket panel is a first pocket panel attached at a lower edge of the second panel and the blank sheet also includes a second pocket panel attached at a fold line to a lower edge of the first panel, wherein when the folder is assembled the second pocket panel is positioned adjacent the first panel;

wherein the fold line between the first pocket panel and the second panel and the fold line between the second pocket panel and the first panel are a common fold line; and wherein the second panel has first and second portions, the backing panel can be positioned to extend along the first portion, and the blank sheet further includes first and second end flaps, the first end flap being attached at a lateral edge of the first panel opposite the second panel and the second end flap being attached at a lateral edge of the second panel opposite the first panel along the second portion.

* * * * *